US007234538B2

(12) United States Patent
Stoetzer

(10) Patent No.: US 7,234,538 B2
(45) Date of Patent: Jun. 26, 2007

(54) METHOD FOR SINKING A BOREHOLE IN THE GROUND AND WET BORING TOOL

(75) Inventor: Erwin Emil Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 273 days.

(21) Appl. No.: 10/873,619

(22) Filed: Jun. 23, 2004

(65) Prior Publication Data

US 2005/0023039 A1 Feb. 3, 2005

(30) Foreign Application Priority Data

Jun. 25, 2003 (DE) ..... 103 28 609

(51) Int. Cl.
*E21B 7/20* (2006.01)
*E21B 27/00* (2006.01)

(52) U.S. Cl. ..... 175/21; 175/308

(58) Field of Classification Search ..... 175/65, 175/21, 245, 88, 308, 403
See application file for complete search history.

(56) References Cited

U.S. PATENT DOCUMENTS 618,332 A * 1/1899 Cloudman ..... 175/10
1,542,172 A * 6/1925 Reed et al. ..... 175/245
2,239,610 A * 4/1941 Kuna ..... 175/315
2,329,461 A * 9/1943 Flynn ..... 175/242
3,430,448 A 3/1969 Gauntt, Jr. et al.
5,735,356 A * 4/1998 Boulard ..... 175/21
6,959,771 B2 * 11/2005 Mazaki et al. ..... 175/57

FOREIGN PATENT DOCUMENTS

DE 19702533 A1 7/1998
DE 19859666 C2 2/2001

* cited by examiner

*Primary Examiner*—Kenneth Thompson
(74) *Attorney, Agent, or Firm*—Jacobson Holman PLLC

(57) ABSTRACT

The invention relates to a method for sinking a borehole in the ground, in which a wet boring tool with a removal area for producing or advancing a borehole is used, the borehole is at least partly filled with a fluid and in the borehole is formed a filling area and the removal area is at least partly washed round by a fluid flow, which conveys the bore smalls produced at the removal area to a collecting container located in the borehole. The method according to the invention is characterized in that the wet boring tool has a pumping mechanism through which fluid from the filling area is made to flow and conveys bore smalls produced into the collecting container. The invention also relates to a wet boring tool and to a boring plant.

22 Claims, 3 Drawing Sheets

METHOD FOR SINKING A BOREHOLE IN THE GROUND AND WET BORING TOOL

BACKGROUND OF THE INVENTION (1) Field of the Invention

The invention relates to a method for sinking a borehole in the ground, a wet boring or drilling tool and a boring or drilling plant.

Fundamentally a distinction is made between two methods, namely dry and wet boring when carrying out boring operations, such as pile foundations.

As the wet boring method involves greater expenditure with respect to the site equipment and restricted boring plant mobility, wherever it is possible use is made of the dry boring method involving the employment of a boring implement on caterpillar carriers or supports. However, when particularly hard geologies are encountered, said method also has limitations. Compared with wet boring, the boring capacity and boring tool wear increase significantly.

(2) Description of Related Art

If a pile bore wall has to e.g. be anchored in rock, the boring rate in the non-rocky substrate is very good in the case of dry boring, but in rock is only a fraction of the normal rate. There is also very significant wear. Only in very rare cases is it possible to convert to the wet boring method, because both the equipment and personnel are not present on site for correctly setting up a wet boring plant.

DE 197 02 533 A1 discloses the relevant prior art. The core bit is either flushed with air or a boring or drilling mud. DE 197 02 533 A1 teaches supplying the core bit by means of a pipe with boring mud from a reservoir located outside the borehole. A fluid flow is produced by means of a hose pump.

Such a known device requires a comparatively complex arrangement of pipes, pumps and fluid reservoirs inside and outside the borehole.

The object of the invention is to provide a method for sinking a borehole in the ground, a wet boring tool and a boring plant permitting a simplified performance of a wet boring method.

SUMMARY OF THE INVENTION

The invention relates to a method for sinking a borehole in the ground, in which a wet boring tool with a removal area for producing or advancing a borehole is used, the borehole is at least partly filled with a fluid and in the borehole is formed a filling area and the removal area is at least partly washed round by a fluid flow, which conveys the bore smalls produced at the removal area to a collecting container located in the borehole. The method according to the invention is characterized in that the wet boring tool has a pumping mechanism through which fluid from the filling area is made to flow and conveys bore smalls produced into the collecting container. The invention also relates to a wet boring tool and to a boring plant.

BRIEF DESCRIPTION OF THE SEVERAL VIEWS OF THE DRAWINGS

The invention is described in greater detail hereinafter relative to preferred embodiments and the attached drawings, wherein show.

DETAILED DESCRIPTION OF THE INVENTION

According to the invention the object is achieved by a method for sinking a borehole, a wet boring tool and a boring plant.

The boring method according to the invention is characterized in that the wet boring tool has a pumping mechanism through which fluid from the filling area can be made to flow and feeds the bore cuttings or smalls occurring into the collecting container.

A fundamental idea of the invention is to produce the fluid flow in the borehole necessary for a wet boring method by the actual boring tool. The wet boring tool is equipped for this purpose with an independent pumping mechanism, which sucks in fluid in the borehole or makes it flow in such a way as to flow round the removal area and feed the bore smalls into the collecting container at the boring tool. Preferably the pumping energy is transmitted by a rotary and/or lifting movement of the boring rod to the boring tool.

Thus, there is no need for costly site equipment with numerous hose lines or pipes inside and outside the borehole in order to perform a wet boring method. Therefore wet boring becomes less expensive and can also be made more flexible due to the simplified handling.

According to a preferred embodiment of the method according to the invention, the fluid flow is produced by a volume change of a working area located in the filling area and in particular the working area is at least partly surrounded by the wet boring tool. Thus, as a result of this volume change in a predetermined working area a planned displacement flow of the liquid in the borehole is brought about.

For a particularly precise setting of the flow, it is preferable that the working area is formed between the wet boring tool and soil material present at said tool and in particular a core.

If use is made of a telescopic rod, e.g. a telescopable Kelly rod or a lifting cylinder at the boring rod, according to the invention the volume change in the working area is brought about by a lifting movement of the wet boring tool in the borehole.

It is alternatively possible according to the invention for the volume change in the working area to be brought about by a rotary movement of a boring rod positioned at the wet boring tool relative to the latter. Through a corresponding threaded mechanism a type of displacement piston can be displaced by a rotary movement, which is preferably in opposition to the rotation during boring operation.

Figure 6:
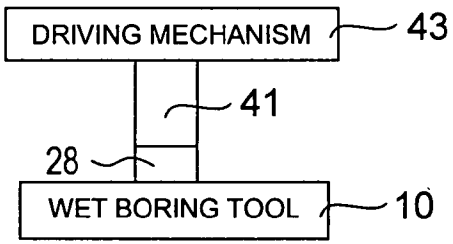
FIG. 6 is a schematic diagram showing the operative connection of the wet boring tool to the driving mechanism.
Figure 5:
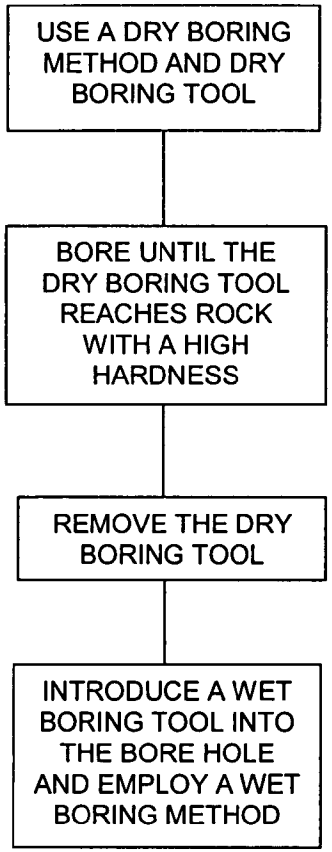
FIG. 5 is a flow diagram showing the incorporation of a dry boring method into the inventive method of the present invention.

The boring method according to the invention need not be a purely wet boring. In fact, according to the invention, for producing the borehole in the ground, initially in a dry boring method boring takes place using a dry boring tool (FIG. 6) and in particular on reaching rock with a greater hardness level the dry boring tool is removed from the borehole, the borehole is then at least partly filled with a fluid and boring is then progressed using the wet boring tool in a wet boring method.

Thus, with this method it is always possible to work with the most favourable boring method as a function of the soil geology encountered. In principle, the wet boring tool can be constructed and used as a dry boring tool and a wet boring operation only takes place after the liquid has been fed into the borehole.

However, it is particularly preferred according to the invention, that use is made of a separate dry boring tool and a separate wet boring tool. The dry boring tool and wet boring tool are driven by the same boring rod, to which are fitted in replaceable manner both the dry and wet boring tools. On reaching a hard rock layer, the dry boring tool with the boring rod is extracted from the borehole and replaced by a wet boring tool.

The wet boring tool according to the invention is characterized in that a pumping mechanism is provided through which fluid from a filling area of a borehole can be made to flow, so that bore cuttings or smalls occurring can be fed into the collecting container.

The wet boring tool according to the invention can be used for the above-described wet boring method and the aforementioned advantages arise.

According to an embodiment of the invention, a jacket tube is provided, on whose underside is located a core bit, particularly in the form of a removal device, and on whose top side is located a cover with at least one passage device for the passage of a fluid, the cover and the jacket tube surrounding an inner area.

According to the invention in the cover is provided a passage device allowing a fluid passage from an area located outside the borehole into the inner area of the wet boring tool. The passage device can be so designed through a valve member that it only allows a fluid passage directed into the inner area. However, in the case of a fluid flow direction change, the valve member is automatically closed.

In an at least partly fluid-filled borehole, such an arrangement according to the invention allows the formation of a fluid circulation, where the fluid passes from an area outside the wet boring tool into the inner area, in said inner area of the wet boring tool if flows downwards to the core bit, flows round the latter and then flows upwards outside the wet boring tool. As a result of this cyclic flow, drill smalls occurring at the core bit can be conveyed away and from there in the upwards direction to the collecting container.

The valve member ensures that there is no fluid flow from the core bit in the removal area into the inner area and consequently there is no accumulation of bore smalls in the inner area. A pumping action maintained by the circulating fluid flow can be produced solely by a rotation of the wet boring tool in boring operation and/or a lifting movement of the wet boring tool. In the case of a boring tool according to the invention, there is no need for pumps or reservoirs located outside the borehole, which allows very simple, inexpensive boring.

The fluid used is preferably water. However, it is fundamentally also possible to use other flushing fluids and suspensions. A boring tool according to the invention can be used in both vertical boreholes and those inclined with respect to the vertical, provided that the boring tool is surrounded by liquid.

It is fundamentally possible to construct the passage device as a simple hole in the cover. However, it is particularly favourable for the passage device to have a tubular dome. Such a tubular dome makes possible the provision of intakes for the feeding of fluid into the inner area and which are spaced from the cover.

In particular, the intakes can be positioned in such a way that the fluid flow directed into the inner area is removed from the borehole at a point where there is limited contamination of the fluid therein by bore smalls. As a result of sedimentation of the bore smalls in the fluid the contamination of the fluid generally decreases with increasing height in the borehole, so that the intakes are preferably spaced from the jacket tube and the cover. Advantageously the tubular dome has at least one lateral intake.

An advantageous further development of the invention is characterized in that the tubular dome is positioned coaxially to the jacket tube on the cover and that on a top side of the dome is provided a rod connection for fitting a boring rod. In this embodiment the dome is used both for the supply of fluid and for the transmission of a torque from the boring rod to the wet boring tool. This allows a particularly cost effective construction of the boring tool.

Fundamentally the valve member can be constructed in the form of any known non-return member. However, in particularly preferred manner the valve member has a spring and/or buoyancy body-operated flap, which permits a particularly cost effective design and construction. The buoyancy member can be filled with air or some other medium which is lighter than the fluid. This ensures a reliable closing and therefore a good blocking action of the flap in the case of a fluid flow directed out of the inner area.

The spring-operated flap can be designed in such a way that it opens in spring-loaded manner in the case of a specific fluid pressure and then, when said fluid pressure drops, automatically closes again as a result of the spring pretension.

It is fundamentally possible to position the valve member at a random point in the dome. In particular, the valve member can be provided in the intake of the tubular dome. However, it is particularly advantageous to provide the valve member in a cross-section of the dome. As a result the valve member can be implemented in a particularly simple and reliably blocking manner.

Preferably the valve member is provided on an underside of the dome. Here the valve member is particularly easily accessible for fitting and maintenance. However, according to the invention, it is also possible to provide several valve members. In particular one valve member can be located in the cross-section of the dome and at least one further valve member in the intake. If there are several intakes, preferably a valve member is located in each intake. With an arrangement of several valve members, it is possible to maintain in a particularly reliable manner a circulating fluid flow.

To produce a strong pumping action on the fluid, it can be advantageous for the rod connection to have a piston element displaceable in the dome. The piston element preferably has a cross-section corresponding to an internal cross-section of the dome. Preferably the dome has a circular internal cross-section and also a circular external cross-section. The piston element is advantageously displaceable in a longitudinal direction of the dome.

In a particularly advantageous further development of the invention, the piston element is displaceable in the dome by rotating the boring rod. More particularly a displacement of the piston element can be brought about by a rotation direction reversal of the boring rod.

Advantageously a boring rotation direction of the boring rod is provided which is used for advancing the core drill. A rotation of the boring rod in a direction opposite to the boring rotation direction can then advantageously bring about a downward movement and/or a movement of the piston element directed towards the inner area. Advantageously a further rotation of the boring rod in the boring rotation direction initially brings about a reverse movement of the piston element back into the starting position before the core drill is again rotated.

When using a displaceable piston element, it can be advantageous to provide valve members both in the dome cross-section and in the intakes. This brings about a particularly reliable pumping action. The pumping action produced by a piston element then brings the resulting liquid flow to the removal area and causes a flushing of the boring location and a conveying away of the bore smalls.

In a particularly preferred further development of the invention, the boring rod is in the form of a telescopable Kelly rod. The dome is appropriately designed as a cylindrical component.

For producing a pumping action, it can also be advantageous for the dome to be retracted into and extended from the jacket tube. Such an insertion and removal of the dome with respect to the jacket tube can in particular be brought about by a rotation of the boring rod and advantageously insertion or retraction is brought about by rotating counter to the boring rotation direction. With such an arrangement, the valve member is appropriately fixed to the jacket tube. Appropriately further valve members are located in the intakes. The insertion and removal of the dome with respect to the jacket tube preferably take place in the axial direction of the dome.

According to the invention, for producing a pumping action, a piston surface with an external cross-section is provided on the underside of the dome which substantially corresponds to an internal cross-section of the jacket tube. This leads to a particularly high pumping volume. The dome can then be provided as a piston rod with fluid supply and outlets. Appropriately the dome can once again be inserted into and extracted from the jacket tube by rotating the boring rod. Appropriately a valve member is located on the jacket tube and advantageously there are further valve members.

A particularly preferred further development of the invention is characterized in that on the top of the cover is provided a collecting container for bore smalls. The collecting container can be cup-shaped, being bounded by the cover or bottom and a tubular wall.

It is fundamentally possible to provide a flow of fluid mixed with bore smalls from the core bit between the jacket tube and a wall of the borehole. However, advantageously on the boring tool is provided at least one flow channel for the passage of fluid mixed with bore smalls. Such a flow channel can e.g. be formed in that a further tube is provided coaxially to the jacket tube. The flow channel is then formed between the jacket tube and the further tube. The further tube can have either a larger or smaller diameter than the jacket tube.

The at least one intake of the tubular dome is advantageously positioned outside the collecting container and particularly above the latter. As a result the only fluid entering the intake is substantially free from bore smalls. Appropriately on the at least one passage opening is provided a particle filter making the passage of bore smalls more difficult.

In a particularly suitable further development of the invention, a raising and lowering of the borer for producing the lifting movement of the wet boring tool during a boring process is performed automatically in time-dependent manner or triggered by an operator. A rotation of the borer can, as desired, be maintained or stopped during raising and lowering.

A boring plant according to the invention is characterized in that the above-described wet boring tool is used as the boring tool.

Figure 2:
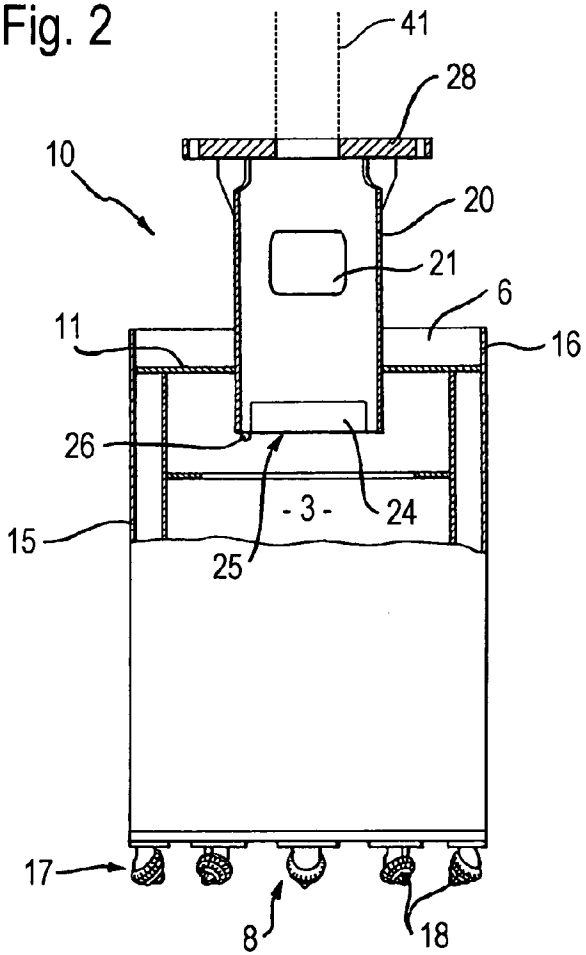
FIG. 2 is a part sectional, diagrammatic side view of the wet boring tool of FIG. 1 with closed flap.
Figure 1:
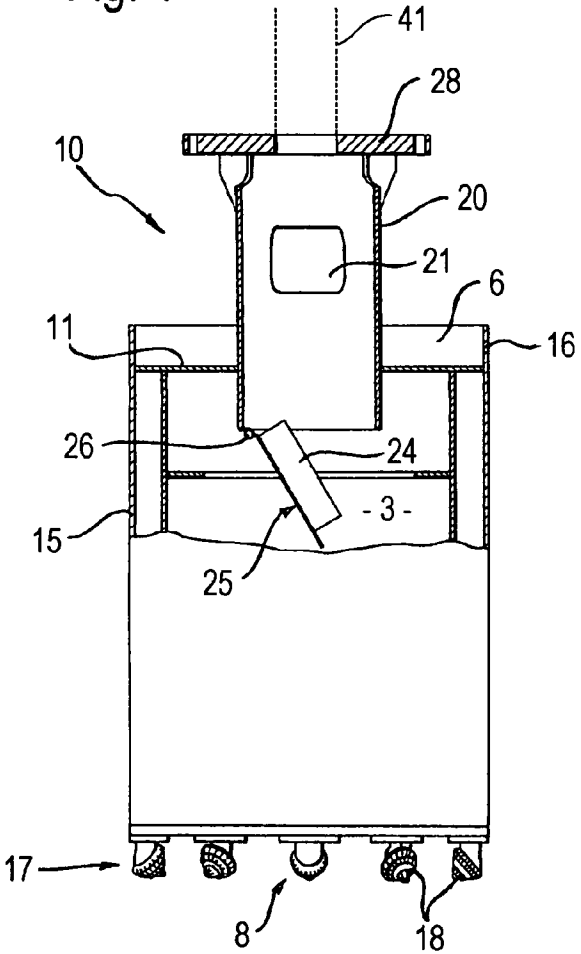
FIG. 1 is a part sectional, diagrammatic side view of a first embodiment of an inventive wet boring tool with opened flap.

A first embodiment of a wet boring tool 10 according to the invention is shown in FIGS. 1 and 2. The wet boring tool 10 has a cylindrical jacket tube 15, on whose lower end is provided a core bit 8, which forms the removal area 17. In the present embodiment the core bit 8 has five roller bits 18, arranged in annular manner in the core bit 8.

On its top surface the jacket tube 15 is terminated by an annular cover 11. A dome 20 is positioned centrally in the annular cover 11. The dome 20 is cylindrical and at its underside passes through the cover 11 into an inner area 3 of the wet boring tool 10. On the top of the dome 20 is provided a rod connection 28 for connection to a rotatable boring rod 41 that is driven by a driving mechanism 43, also shown in FIGS. 1 and 6.

On the top of the cover 11 is positioned a collecting container 6 for receiving worked bore cuttings or smalls. The collecting container 6 is bounded by the cover 11, dome 20 and cylindrical extension 16 of the jacket tube 15 and is cup-shaped with an annular cross-section. A substantially rectangular intake 21 is laterally provided in dome 20. The intake 21, through which fluid can pass into the dome 20 and from there into the inner area 3 of the wet boring tool 10, is formed above the collecting container 6.

On the underside of the dome 20 is provided a flap 25, shown in the open state in FIG. 1 and in the closed state in FIG. 2. The flap 25 is designed as a non-return member in such a way that it permits the passage of a fluid flow directed into the inner area 3 and moving through the dome 20, but blocks an oppositely directed fluid flow. For this purpose the flap 25 is constructed as a circular plate, which is articulated to the dome 20 by a hinge 26 on one side. When the flap 25 is in the closed state it completely covers the open underside of the dome 20, but said flap 25 is inclined into the inner area 3 of the wet boring tool 10 in the open state. On the top the flap 25 has a buoyancy member 24.

The embodiment shown in FIGS. 1 and 2 is suitable for producing a fluid flow for conveying bore smalls out of the removal area 17 into the collecting container 6 during a lifting movement of the wet boring tool 10 in the longitudinal direction of the jacket tube 15. The inner area 3 of the wet boring tool 10 forms a working area of a pumping mechanism. A core (not shown) entering the inner area 3 acts as a piston element bringing about a volume change in the fluid-filled inner area 3.

On raising the wet boring tool 10 in the longitudinal direction of the jacket tube 15, the not shown core is extracted from the inner area 3. Due to the resulting pressure drop in the inner area 3, the flap 25 opens and the fluid flows through the intake 21 into the dome 20 and from there into the inner area 3. During the subsequent lowering of the wet boring tool 10, the not shown core again enters the inner area 3, so that the fluid pressure in the latter rises. As a result the flap 25 is closed. Fluid, displaced from the inner area 3 by the penetrating core, flows past the core to the core bit 8, from where bore smalls are conveyed along the jacket tube 15 into the collecting container 6.

Figure 4:
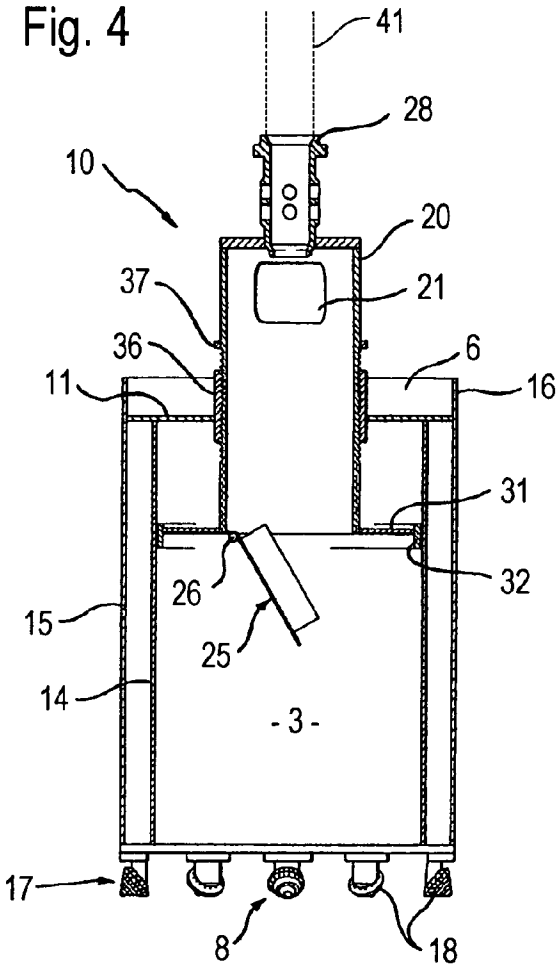
FIG. 4 is a diagrammatic longitudinal section through another embodiment of an inventive wet boring tool with an extendible and retractable dome, on whose underside is provided a piston surface.
Figure 3:
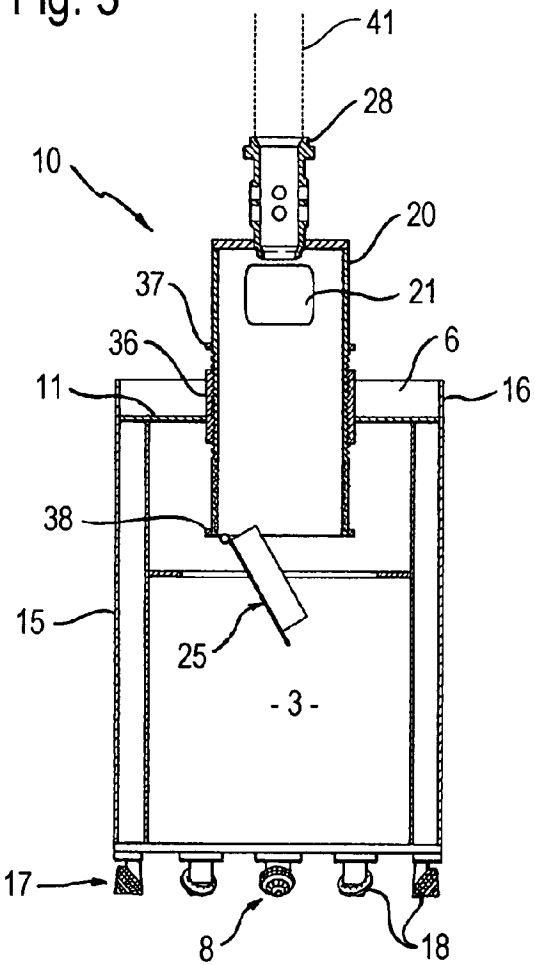
FIG. 3 is a diagrammatic longitudinal section through a further embodiment of an inventive wet boring tool with a dome extendible and retractable with respect to the jacket tube.

Further embodiments of inventive wet boring tools 10 are shown in FIGS. 3 and 4. Components with the same function are given the same reference numerals as in FIGS. 1 and 2 are not described again here. The embodiment of FIG. 3 differs from that described hereinbefore in that the dome 20 can be extended into and retracted from the inner area 3 of the wet boring tool 10. A threaded sleeve 36 is centrally provided for this purpose on the cover 11. On the inside the threaded sleeve 36 has a screw thread, which corresponds to a thread formed on the exterior of the dome 20. By rotating the dome 20 relative to the cover 11 and jacket tube 15, the dome 20 can be displaced relative to the cover 11 in the longitudinal direction of the jacket tube 15. The retraction of the dome 20 is limited by an annular, upper stop 37 and the extension of the dome by an annular, lower stop 38. The rotation of the dome 20 is brought about by a boring rod 41 driven by a driving mechanism 43 to rotate with the dome via the rod connection 28 of the wet boring tool 10 as whon in FIGS. 3 and 6.

With the embodiment of a wet boring tool 10 shown in FIG. 3, it is possible to bring about a volume change to the working area in the inner area 3 and consequently a pumping action for the fluid by a rotary movement of the not shown boring rod. The dome 20 with the flap 25 at the bottom acts as a piston element.

The embodiment of an inventive wet boring tool 10 shown in FIG. 4 differs from that of FIG. 3 in that an annular piston surface 31 is provided on the bottom of the dome 20. The inner circumference of the annular piston surface 31 corresponds to the outer circumference of the cylindrical dome 20. On the outer circumference of the piston surface 31 is provided a cylindrical ring element 32, which engages on a cylindrical inner tube 14. The inner tube 14 is arranged within and concentrically to the jacket tube 15. A lower stop 38 is not provided in the embodiment of FIG. 4 and its function is taken over by the piston surface 31.

In the embodiment according to FIG. 4, the working area is constructed in the interior of the inner tube 14. A rotation of the dome 20 relative to the jacket tube 15 brings about an upward or downward movement of the dome in rotation direction-dependent manner, as well as the piston surface 31 positioned thereon relative to the inner area 3, which leads to a volume change of the working area and consequently a pumping action. Between the inner tube 14 and jacket tube 15 is formed a flow channel for a flow of fluid mixed with bore smalls directed from the removal area 17 to the collecting container 6.

The invention claimed is:

1. A wet boring tool for making or advancing a borehole with a filling area in the ground through the use of fluid, the wet boring tool comprising:

a jacket tube having a top side and an underside;

a core bit on the underside, the core bit forming a removal area;

a cover on the top side with at least one passage device for the passage of the fluid into an inner area surrounded by the cover and jacket tube;

a collecting container for receiving bore smalls produced by the core bit; and a pumping mechanism through which fluid from the filling area of the borehole can be made to flow round the removal area and as a result produced bore smalls can be fed into the collecting container.

2. Wet boring tool according to claim 1, wherein at the top, on the cover, the collecting container for bore smalls is provided.

3. Wet boring tool according to claim 1, wherein the passage device has a valve member, which allows a fluid flow directed into the inner area through the passage device and blocks the passage device in the case of an oppositely directed fluid flow.

4. Wet boring tool according to claim 3, wherein the valve member has a spring and/or buoyancy body-operated flap.

5. Wet boring tool according to claim 1, wherein the passage device has a tubular dome.

6. Wet boring tool according to claim 5, wherein the tubular dome has at least one more particularly laterally positioned intake.

7. Wet boring tool according to claim 6, wherein the at least one intake is positioned above the collecting container.

8. Wet boring tool according to claim 5, wherein the tubular dome is arranged coaxially with respect to the jacket tube on the cover and that on a top surface of the dome is provided a rod connection for fitting a boring rod.

9. Wet boring tool according to claim 8, wherein the rod connection has a piston element, which is in particular displaceable by rotating the boring rod in the dome.

10. Wet boring tool according to claim 9, wherein the piston element is displaceable in a longitudinal direction of the dome.

11. Wet boring tool according to claim 8, wherein the dome can be retracted into and extended from the jacket tube by rotating the boring rod.

12. Wet boring tool according to claim 11, wherein on the underside of the dome is provided a piston surface with an outside cross-section essentially corresponding to an inside cross-section of the jacket tube.

13. Wet boring tool according to claim 11, wherein the dome can be retracted into and extended from the jacket tube in the axial direction of the dome.

14. Wet boring tool according to claim 5, wherein the valve member is provided in a cross-section of the dome, particularly on an underside of the dome.

15. A method for making or advancing a borehole in the ground through the use of fluid and the wet boring tool of claim 1, the method comprising the steps of:

at least partly filling the borehole with a fluid;

forming a filling area in the borehole;

washing the removal area by fluid flow;

conveying the bore smalls occurring in the removal area away to the collecting container of the wet boring tool located in the borehole; and using the pumping mechanism to cause fluid to flow from the filling area to convey the bore smalls into the collecting container.

16. Method according to claim 15, wherein the fluid flow is produced by a volume change to a working area located in the filling area and in particular the working area is at least partly surrounded by the wet boring tool.

17. Method according to claim 16, wherein the working area is formed between the wet boring tool and soil material arising at said wet boring tool.

18. Method according to claim 16, wherein the volume change in the working area is brought about by a lifting movement of the wet boring tool in the borehole.

19. Method according to claim 16, wherein the volume change in the working area is brought about by a rotary movement relative to the wet boring tool by a boring rod operatively connected to the wet boring tool.

20. Method according to claim 15, wherein for making the borehole in the ground, firstly using a dry boring method and a dry boring tool boring takes place and in particular on reaching rock with a higher hardness level the dry boring tool is removed from the borehole, which is then at least partly filled with a fluid and boring is continued in a wet boring method using the wet boring tool.

21. Method according to claim 20, wherein the dry boring tool and the wet boring tool are driven by a boring rod, to which are interchangeably fitted the dry boring tool and the wet boring tool.

22. A boring plant comprising:

a boring rod;

a drive mechanism for driving the boring rod in rotary manner;

means for displaceably guiding the boring rod; and a wet boring tool for making or advancing a borehole with a filling area in the ground through the use of fluid, the wet boring tool including a jacket tube having a top side and an underside, a core bit on the underside, the core bit forming a removal area, a cover on the top side with at least one passage device for the passage of the fluid into an inner area surrounded by the cover and jacket tube, a collecting container for receiving bore smalls produced by the core bit, and a pumping mechanism through which fluid from the filling area of the borehole can be made to flow round the removal area and as a result produced bore smalls can be fed into the collecting container; and means for operatively connecting the boring rod to the cover on the top side of the jacket tube.

* * * * *